US010390401B2

(12) United States Patent
Gotou et al.

(10) Patent No.: US 10,390,401 B2
(45) Date of Patent: Aug. 20, 2019

(54) LIGHTING CONTROL DEVICE HAVING A CORRECTOR INTEGRALLY WITH A CONTROLLER THEREOF FOR CORRECTING A DIMMING PRESCRIBED RANGE STORED THEREIN

(71) Applicant: Panasonic Intellectual Property Management Co., Ltd., Osaka (JP)

(72) Inventors: Kiyosi Gotou, Hyogo (JP); Tomohiro Miyake, Mie (JP); Eiichirou Niikura, Mie (JP); Kengo Miyamoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/757,349

(22) PCT Filed: Sep. 2, 2016

(86) PCT No.: PCT/JP2016/004013
§ 371 (c)(1),
(2) Date: Mar. 3, 2018

(87) PCT Pub. No.: WO2017/043060
PCT Pub. Date: Mar. 16, 2017

(65) Prior Publication Data

US 2019/0029089 A1 Jan. 24, 2019

(30) Foreign Application Priority Data

Sep. 10, 2015 (JP) ..... 2015-178867

(51) Int. Cl.
*H05B 37/02* (2006.01)
*H05B 33/08* (2006.01)
(Continued)

(52) U.S. Cl.
CPC ..... *H05B 33/0845* (2013.01); *F21V 23/02* (2013.01); *H05B 33/0815* (2013.01);
(Continued)

(58) Field of Classification Search
CPC ..... H05B 33/0845; H05B 33/0884
(Continued)

(56) References Cited

U.S. PATENT DOCUMENTS 6,949,885 B2 * 9/2005 Hamamoto ..... H05B 41/2985 315/200 R
8,253,403 B2 * 8/2012 Chen ..... H02M 3/158 323/282
(Continued)

FOREIGN PATENT DOCUMENTS

CN 101171885 A 4/2008
EP 2 654 379 A1 10/2013
(Continued)

OTHER PUBLICATIONS

Extended European Search Report for corresponding Application No. 16843928.9, dated Aug. 3, 2018.
(Continued)

*Primary Examiner* — Thuy V Tran
(74) *Attorney, Agent, or Firm* — Renner, Otto, Boisselle & Sklar, LLP

(57) ABSTRACT

A lighting control device includes a bidirectional switch, an inputter, a controller, and a corrector. The bidirectional switch is configured to switch between conduction and non-conduction of a bidirectional current between a pair of input terminals. The inputter is configured to receive a dimming level specifying the magnitude of a light output of a load. The controller is configured to control the bidirectional switch so as to retain the bidirectional switch in an ON state for an on time having a length determined in accor-
(Continued)

dance with the dimming level within a prescribed range in each of half periods of an AC voltage of an AC power supply. The corrector is configured to (i) determine whether or not a target waveform has an anomaly with reference to a prescribed determination condition, and (ii) correct the prescribed range so as to narrow the prescribed range when the target waveform has the anomaly; wherein the target waveform is a waveform of at least one of a voltage and a current input to the pair of input terminals.

12 Claims, 6 Drawing Sheets

(51) Int. Cl.
*F21V 23/02* (2006.01)
*F21Y 115/10* (2016.01)

(52) U.S. Cl.
CPC ..... *H05B 37/0245* (2013.01); *F21Y 2115/10* (2016.08); *H05B 33/0884* (2013.01)

(58) Field of Classification Search
USPC ..... 315/291, 308
See application file for complete search history.

(56) References Cited

U.S. PATENT DOCUMENTS

| | | | | |
|---|---|---|---|---|
| 8,716,957 | B2 | 5/2014 | Melanson et al. | |
| 2006/0158131 | A1* | 7/2006 | Mitsuyasu ..... | H02M 7/53803 315/209 R |
| 2012/0112651 | A1* | 5/2012 | King ..... | H05B 33/0815 315/224 |
| 2013/0187563 | A1 | 7/2013 | Sasai et al. | |
| 2013/0300301 | A1 | 11/2013 | Miyahara et al. | |

FOREIGN PATENT DOCUMENTS

| | | | |
|---|---|---|---|
| JP | H11-185979 | A | 7/1999 |
| JP | 2013-149498 | A | 8/2013 |
| JP | 2014-086190 | A | 5/2014 |
| TW | 201215222 | A | 4/2012 |
| WO | 2006/124278 | A2 | 11/2006 |
| WO | 2011/145009 | A1 | 11/2011 |
| WO | 2014/092998 | A1 | 6/2014 |

OTHER PUBLICATIONS

International Search Report and Written Opinion for corresponding International Application No. PCT/JP2016/004013, dated Nov. 11, 2016.

* cited by examiner

LIGHTING CONTROL DEVICE HAVING A CORRECTOR INTEGRALLY WITH A CONTROLLER THEREOF FOR CORRECTING A DIMMING PRESCRIBED RANGE STORED THEREIN

TECHNICAL FIELD

The present invention relates to a lighting control device for dimming an illumination load.

BACKGROUND ART

A lighting control device for dimming an illumination load is known (e.g., Patent Literature 1).

The lighting control device described in Patent Literature 1 includes a pair of terminals, a control circuit, a control power supply configured to supply control electric power to the control circuit, and a dimming manipulation section configured to set the dimming level of the illumination load.

Between the pair of terminals, the control circuit and the control power supply are connected in parallel to each other. Moreover, between the pair of terminals, a series circuit of an alternating current (AC) power supply and an illumination load is connected. The illumination load includes a plurality of light emitting diode (LED) devices and a power supply circuit configured to light the LED devices. The power supply circuit includes a smoothing circuit of a diode and an electrolytic capacitor.

The control circuit includes a switch which enables phase control of an AC voltage to be supplied to the illumination load, a switch driver configured to drive the switch, and a controller configured to control the switch driver and the control power supply.

The control power supply is connected in parallel to the switch. The control power supply converts the AC voltage of the AC power supply into control electric power. The control power supply includes an electrolytic capacitor configured to store the control electric power.

The controller is supplied with the control electric power from the control power supply via the electrolytic capacitor. The controller includes a microcomputer. The microcomputer performs reverse phase control in accordance with a dimming level set by the dimming manipulation section to interrupt power supply to the illumination load during a time period of each of half cycles of the AC voltage.

CITATION LIST

Patent Literature

Patent Literature 1: JP 2013-149498 A

SUMMARY OF INVENTION

It is an object of the present invention to provide a lighting control device which is compatible with an increased number of types of illumination loads.

A lighting control device according to one aspect of the present invention includes a pair of input terminals, a bidirectional switch, an inputter, a controller, and a corrector. The pair of input terminals is electrically connected to an illumination load and an AC power supply. The bidirectional switch is configured to switch between conduction and non-conduction of a bidirectional current between the pair of input terminals. The inputter is configured to receive a dimming level specifying a magnitude of a light output of the illumination load. The controller is configured to control the bidirectional switch so as to retain the bidirectional switch in an ON state for an on time having a length determined in accordance with the dimming level within a prescribed range in each of half periods of an AC voltage of the AC power supply. The corrector is configured to determine, with reference to a determination condition, whether or not a target waveform which is a waveform of at least one of a voltage and a current input to the pair of input terminals has an anomaly and to correct the prescribed range so as to narrow the prescribed range when the target waveform has the anomaly.

DESCRIPTION OF EMBODIMENTS

The following configurations are mere examples of the present invention. The present invention is not limited to the following embodiments. Even in embodiments other than these embodiments, various modifications may be made depending on design and the like without departing from the technical idea of the present invention.

First Embodiment (1.1) Configuration

Figure 1:
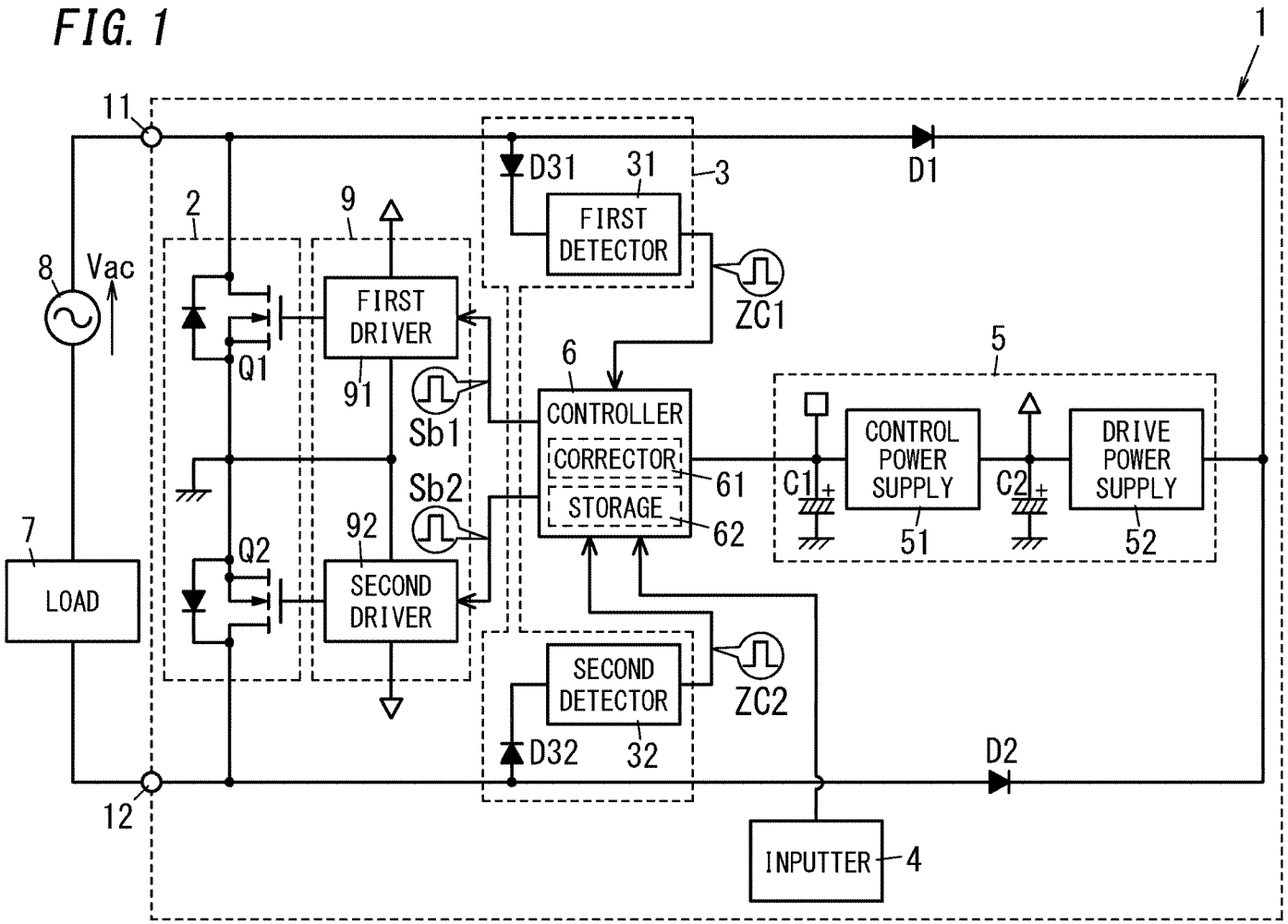
FIG. 1 is a circuit diagram schematically illustrating a configuration of a lighting control device according to a first embodiment.

As illustrated in FIG. 1, a lighting control device 1 of a first embodiment includes a pair of input terminals 11 and 12, a bidirectional switch 2, a phase detector 3, an inputter 4, a power supply 5, a controller 6, a switch driver 9, and diodes D1 and D2. The controller 6 includes a corrector 61. The "input terminal" mentioned herein may not have an entity as a part (terminal) to which an electric wire or the like is to be connected, but the "input terminal" may be, for example, a lead of an electronic component, or a part of a conductor included in a circuit board.

The lighting control device 1 is a two-wire lighting control device and is used electrically connected in series to an illumination load (hereinafter referred to simply as "load") 7 with respect to an AC power supply 8. The load 7 is lit when supplied with electric power. The load 7 includes an LED device as a light source and a lighting circuit configured to light the LED device. The AC power supply 8 is, for example, a commercial power supply having a single phase 100 V and 60 Hz. The lighting control device 1 is applicable to, for example, a wall switch.

The bidirectional switch 2 includes, for example, two devices, namely a first switching device Q1 and a second switching device Q2 electrically connected in series between the input terminals 11 and 12. For example, each of the switching devices Q1 and Q2 is a semiconductor switching device including an enhancement n-channel metal-oxide-semiconductor field effect transistor (MOSFET).

The switching devices Q1 and Q2 are connected in a so-called anti-series connection between the input terminals 11 and 12. That is, the sources of the switching devices Q1 and Q2 are connected to each other. The drain of the switching device Q1 is connected to the input terminal 11, and the drain of the switching device Q2 is connected to the input terminal 12. The sources of both of the switching devices Q1 and Q2 are connected to ground of the power supply 5. The ground of the power supply 5 corresponds to a reference potential for an internal circuit of the lighting control device 1.

The bidirectional switch 2 is capable of switching among four states by a combination of on and off of the switching devices Q1 and Q2. The four states include a bidirectionally off state where both the switching devices Q1 and Q2 are off, a bidirectionally on state where both the switching devices Q1 and Q2 are on, and two kinds of unidirectionally on states: a case where only the switching device Q1 is on and a case where only the switching device Q2 is on. In a unidirectionally on state, unidirectional conduction is established between the pair of input terminals 11 and 12, from one of the switching devices Q1 and Q2 which is on, through a parasitic diode of the other of the switching devices Q1 and Q2 which is off. For example, when the switching device Q1 is on and the switching device Q2 is off, a first unidirectionally on state where a current flows from the input terminal 11 toward the input terminal 12 is achieved. Alternatively, when the switching device Q2 is on and the switching device Q1 is off, a second unidirectionally on state where a current flows from the input terminal 12 toward the input terminal 11 is achieved. Thus, when an AC voltage Vac is applied from the AC power supply 8 between the input terminals 11 and 12, in a positive polarity of the AC voltage Vac, that is, in a half period in which the input terminal 11 has a high potential, the first unidirectionally on state is a forward on state, and the second unidirectionally on state is a reverse on state. On the other hand, in a negative polarity of the AC voltage Vac, that is, in a half period in which the input terminal 12 has the high potential, the second unidirectionally on state is the forward on state, and the first unidirectionally on state is the reverse on state.

Here, the bidirectional switch 2 is in an on state in both the bidirectionally on state and the forward on state, and is in an off state in both the bidirectionally off state and the reverse on state.

The phase detector 3 detects the phase of the AC voltage Vac applied between the input terminals 11 and 12. The "phase" mentioned herein includes a zero crossing point of the AC voltage Vac and the polarity (positive polarity, negative polarity) of the AC voltage Vac. The phase detector 3 is configured to output a detection signal to the controller 6 when the phase detector 3 detects the zero crossing point of the AC voltage Vac. The phase detector 3 includes a diode D31, a first detector 31, a diode D32, and a second detector 32. The first detector 31 is electrically connected to the input terminal 11 via the diode D31. The second detector 32 is electrically connected to the input terminal 12 via the diode D32. The first detector 31 detects a zero crossing point when the AC voltage Vac transitions from a negative half period to a positive half period. The second detector 32 detects a zero crossing point when the AC voltage Vac transitions from the positive half period to the negative half period.

That is, the first detector 31 determines the zero crossing point when detecting a transition from a state where a voltage with the input terminal 11 having a high electric potential is lower than a specified value to a state where the voltage with the input terminal 11 having the high electric potential is higher than or equal to the specified value. The first detector 31 outputs a first detection signal ZC1 to the controller 6 when detecting the transition. Similarly, the second detector 32 determines the zero crossing point when detecting a transition from a state where a voltage with the input terminal 12 having a high electric potential is lower than a specified value to a state where the voltage with the input terminal 12 having a high electric potential is higher than or equal to the specified value. The second detector 32 outputs a second detection signal ZC2 to the controller 6 when detecting the transition. The specified value is a value (an absolute value) set close to 0 V. For example, the specified value of the first detector 31 is a value about several volts, and the specified value of the second detector 32 is a value about several volts. Thus, detection points at which the zero crossing points are detected by the first detector 31 and the second detector 32 are a little later than the zero crossing points (0 V) in a strict sense.

The inputter 4 receives a signal denoting the dimming level from a manipulation section manipulated by a user and outputs the signal as a dimming signal to the controller 6. The inputter 4 may process the received signal or does not have to process the received signal to output the dimming signal. The dimming signal corresponds to a numerical value or the like specifying the magnitude of the light output of the load 7 and may include an off level at which the load 7 is in a non-lighting state. The manipulation section is only required to be configured to be manipulated by a user to output a signal denoting the dimming level to the inputter 4. The manipulation section may be, for example, a variable resistor, a rotary switch, a touch panel, a remote controller, or a communication terminal such as a smartphone.

The controller 6 controls the bidirectional switch 2 on the basis of the detection signals from the phase detector 3 and the dimming signal from the inputter 4. The controller 6 individually controls the switching devices Q1 and Q2. Specifically, the controller 6 controls the switching device Q1 by a first control signal Sb1 and controls the switching device Q2 by a second control signal Sb2.

The controller 6 includes, for example, a microcomputer as a main configuration. The microcomputer executes a program stored in memory of the microcomputer by a central processing unit (CPU) to realize a function as the controller 6. The program may be stored in the memory of the microcomputer in advance, may be provided as a recording medium such as a memory card storing the program, or may be provided via an electronic communication network. In other words, the program is a program which causes a computer (in this embodiment the microcomputer) to function as the controller 6.

When the controller 6 receives the dimming signal from the inputter 4, the controller 6 extracts information corresponding to the dimming level from the dimming signal. In this embodiment, the dimming signal includes a numerical value or the like specifying the magnitude of the light output of the load 7. Thus, information such as the numerical value corresponds to the dimming level. The memory of the controller 6 stores a table denoting a correspondence relationship between the dimming level and an on time. The controller 6 refers to the table to obtain an on time corresponding to the dimming level extracted from the dimming signal. The controller 6 controls the switching devices Q1 and Q2 so as to retain the bidirectional switch 2 in the ON state for the on time in every half period of the AC voltage Vac.

In the present embodiment, the on time is determined within a prescribed range. Thus, there may be a case where the on time is not determined in accordance with the dimming level input to the inputter 4. For example, even when a user manipulates the manipulation section in attempt to obtain a maximum light output of the load 7, there may be a case where the on time is not determined in accordance with the dimming signal from the inputter since the on time is limited within the prescribed range. The on time at this time is an upper limit value of the prescribed range. Specifically, for example, when an on time for a dimming level of 95% is set as the upper limit value of the prescribed range, an on time for a dimming level of 96% or 97% is limited to or below the upper limit value. Thus, even when the dimming level is 96% or 97%, an on time which is the same as the on time for a dimming level of 95% is adopted.

The switch driver 9 includes a first driver 91 configured to drive (perform on/off control of) the switching device Q1 and a second driver 92 configured to drive (perform on/off control of) the switching device Q2. The first driver 91 receives the first control signal Sb1 from the controller 6 to apply a gate voltage to the switching device Q1. In this way, the first driver 91 performs the on/off control of the switching device Q1. Similarly, the second driver 92 receives the second control signal Sb2 from the controller 6 to apply a gate voltage to the switching device Q2. In this way, the second driver 92 performs the on/off control of the switching device Q2. The first driver 91 generates the gate voltage with reference to the potential of the source of the switching device Q1. The same applies to the second driver 92.

The power supply 5 includes a control power supply 51 configured to generate control electric power and a drive power supply 52 configured to generate drive electric power. The power supply 5 further includes capacitive elements (capacitors) C1 and C2. The control electric power is power by which the controller 6 is operated. The drive electric power is power by which the switch driver 9 is driven. The capacitive element C1 is electrically connected to an output terminal of the control power supply 51 and is charged with an output current of the control power supply 51. The capacitive element C2 is electrically connected to an output terminal of the drive power supply 52 and is charged with an output current of the drive power supply 52.

The power supply 5 is electrically connected to the input terminal 11 via the diode D1 and is electrically connected to the input terminal 12 via the diode D2. Thus, a diode bridge including the diodes D1 and D2 and parasitic diodes of the switching devices Q1 and Q2 performs full-wave rectification of the AC voltage Vac applied between the input terminals 11 and 12, and the full-wave rectified AC voltage Vac is then supplied to the power supply 5. Thus, when the bidirectional switch 2 is in the off state, the full-wave rectified AC voltage Vac (a pulsating voltage output from the diode bridge) is to be applied to the power supply 5.

The full wave-rectified AC voltage Vac is applied to the drive power supply 52, and the drive power supply 52 thereby generates drive electric power which is a constant voltage and outputs the drive electric power to the capacitive element C2. The drive power supply 52 supplies the drive electric power to the switch driver 9 and the control power supply 51. The drive electric power is, for example, 10 V. The control power supply 51 steps down the drive electric power supplied from the drive power supply 52 to generate control electric power and outputs the control electric power to the capacitive element C1. The control electric power is, for example, 3 V. The control power supply 51 may generate the control electric power directly from the full-wave rectified AC voltage Vac but not via the drive power supply 52. That is, the power supply 5 generates the control electric power and the drive electric power from the electric power supplied from the AC power supply 8.

The corrector 61 serves as one function of the controller 6 in the present embodiment and is disposed integrally with the controller 6. The corrector 61 determines, with reference to a determination condition, whether or not a target waveform has an anomaly. The corrector 61 narrows the prescribed range when the target waveform has the anomaly. In the present embodiment, the target waveform is a voltage waveform input to the pair of input terminals 11 and 12. Detailed description of the determination condition will be given in "(1.2.3) Operation of Corrector". In the present embodiment, the determination condition which the corrector 61 refers to is that the zero crossing point of the AC voltage Vac is regularly detected. In other words, the determination condition which the corrector 61 refers to is that the detection signal is regularly input from the phase detector 3 to the corrector 61. The corrector 61 determines whether or not the target waveform has an anomaly in accordance with the detection signal from the phase detector 3. When the detection signal is irregularly input to the corrector 61, the corrector 61 determines that the target waveform has the anomaly. That is, in the present embodiment, the corrector 61 simply determines whether or not the target waveform has an anomaly with reference to the zero crossing point of the target waveform.

As described above, the prescribed range is defined by the upper limit value and the lower limit value. Thus, the corrector 61 changes at least one of the upper limit value and the lower limit value to correct the prescribed range. In the present embodiment, the lower limit value is a fixed value, and the corrector 61 changes only the upper limit value to correct the prescribed range. That is, when the target waveform has an anomaly, the corrector 61 corrects the prescribed range by changing the upper limit value to a reduced value so as to narrow the prescribed range. In the present embodiment, the corrector 61 corrects the on time obtained by the controller 6 such that the on time falls within a prescribed range which is corrected. In this way, direct narrowing of the prescribed range is achieved.

For example, it is assumed that the target waveform has an anomaly with the dimming level being set to its maximum (in the present embodiment, 97%). In this case, the corrector 61 corrects the on time such that the on time becomes shorter than the on time corresponding to the dimming level (here 97%) obtained by the controller 6 with reference to the table by a correction time which is prescribed. Thus, the controller 6 controls the bidirectional switch 2 by adopting the on time which is shorter than the on time corresponding to the dimming level (in this embodiment, 97%) by the correction time. Consequently, the prescribed range is narrowed.

The lighting control device 1 of the present embodiment further includes storage 62. The storage 62 stores the prescribed range. In the present embodiment, the storage 62 serves as a function of the controller 6 and is disposed integrally with the controller 6. The storage 62 stores the upper limit value and the lower limit value which define the prescribed range. The storage 62 stores an upper limit value and a lower limit value as default values as a factory default setting of the lighting control device 1.

In this embodiment, the storage 62 is configured to store a prescribed range corrected by the corrector 61. That is, when the target waveform has an anomaly, and the corrector 61 corrects the upper limit value by changing the upper limit value to a reduced value, the storage 62 stores the upper limit value after the correction. In the present embodiment, the upper limit value and the lower limit value stored in the storage 62 are reset to the default values each time the dimming level transitions to the OFF level. Thus, even when the target waveform has an anomaly, and the corrector 61 corrects the prescribed range to narrow the prescribed range, if the load 7 thereafter enters the non-lighting state, the upper limit value and the lower limit value stored in the storage 62 are reset to the default values.

However, the controller 6 of the lighting control device 1 of the present embodiment has a learning function for retaining the upper limit value and the lower limit value stored in the storage 62 when the corrector 61 corrects the prescribed range for the specified number of times. That is, when the corrector 61 corrects the prescribed range for a specified number of times, the upper limit value and the lower limit value stored in the storage 62 are not reset to the default values, but the corrected prescribed range (upper limit value and lower limit value) is to be retained in the storage 62. The specified number of times is set, for example, within a range from several times to several tens of times, but the specified number of times is not limited to this example. The specified number of times may be once.

The lighting circuit of the load 7 reads a dimming level from the waveform of the AC voltage Vac phase-controlled by the lighting control device 1 to vary the magnitude of the light output of the LED device. Here, the lighting circuit includes, for example, a circuit for securing a current such as a bleeder circuit. Thus, also during a time period during which the bidirectional switch 2 of the lighting control device 1 is non-conductive, a current is allowed to pass through the load 7.

(1.2) Operation (1.2.1) Activation Operation

First, activation operation when conduction of the lighting control device 1 of the present embodiment is started will be described.

In the lighting control device 1 having the above-described configuration, when the AC power supply 8 is connected between the input terminals 11 and 12 via the load 7, the AC voltage Vac applied between the input terminals 11 and 12 from the AC power supply 8 is rectified and is then supplied to the drive power supply 52. The drive electric power generated by the drive power supply 52 is supplied to the switch driver 9 and the control power supply 51. When the control electric power generated by the control power supply 51 is supplied to the controller 6, the controller 6 is activated.

When the controller 6 is activated, the controller 6 determines the frequency of the AC power supply 8 on the basis of a detection signal of the phase detector 3. Then, on the basis of the frequency determined by the controller 6, the controller 6 refers to a numerical value table stored in memory in advance to set various types of parameters such as a time. Here, if the dimming level input to the inputter 4 is the off level, the controller 6 maintains the bidirectional switch 2 in the bidirectionally off state to keep the impedance between the pair of input terminals 11 and 12 in a high impedance state. Thus, the load 7 keeps a non-lighting state.

(1.2.2) Dimming Operation

Figure 2:
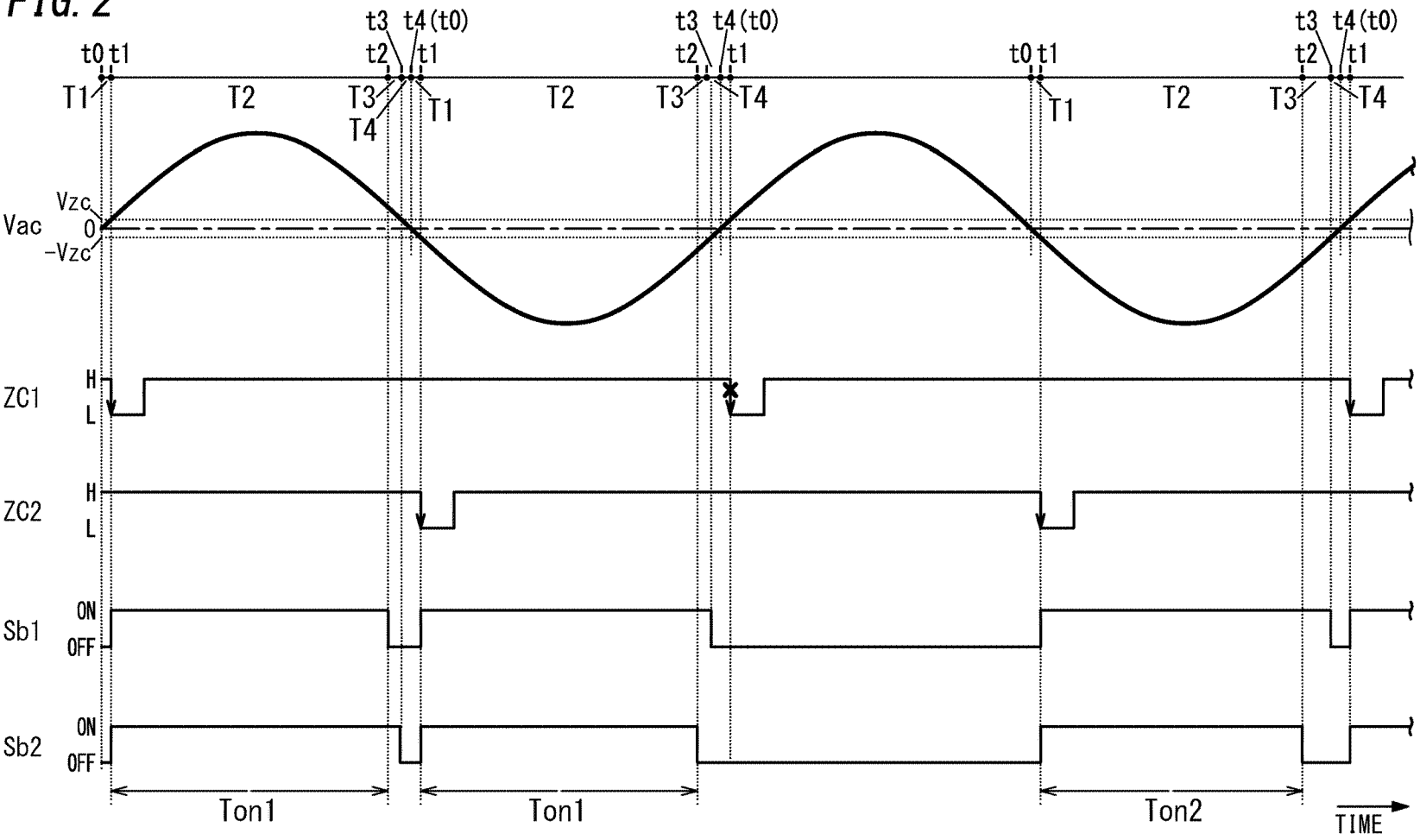
FIG. 2 is a timing chart illustrating operation of the lighting control device according to the first embodiment.

Next, dimming operation of the lighting control device 1 of the present embodiment will be described with reference to FIG. 2. FIG. 2 shows the AC voltage Vac, the first detection signal ZC1, the second detection signal ZC2, the first control signal Sb1, and the second control signal Sb2.

In the present embodiment, transition of the first detection signal ZC1 from a high level to a low level means generation of the first detection signal ZC1. Moreover, transition of the second detection signal ZC2 from the high level to the low level means generation of the second detection signal ZC2. That is, the first detection signal ZC1 and the second detection signal ZC2 are signals which transition from the high level to the low level when the zero crossing point is detected.

First, the operation of the lighting control device 1 during a positive half period of the AC voltage Vac is described. The lighting control device 1 detects the zero crossing point of the AC voltage Vac by the phase detector 3. The zero crossing point serves as a reference for phase control. The first detector 31 outputs the first detection signal ZC1 when the AC voltage Vac reaches a positive specified value Vzc in the course of a transition of the AC voltage Vac from a negative half period to the positive half period. In the present embodiment, a generation time point of the first detection signal ZC1 is defined as a first time point t1, and a time period from a starting point (zero crossing point) t0 to the first time point t1 of the positive half period is defined as a first time period T1. During the first time period T1 from the starting point t0 to a first time point t1 of the half period, the controller 6 retains the first control signal Sb1 and the second control signal Sb2 as OFF signals. Thus, during the first time period T1, both the switching devices Q1 and Q2 are off, and the bidirectional switch 2 is in the bidirectionally off state. At the first time point t1, the controller 6 sets the first control signal Sb1 and the second control signal Sb2 to ON signals.

A second time point t2 is a time point when the on time having a length according to the dimming signal elapses from the first time point t1. At the second time point t2, the controller 6 keeps the second control signal Sb2 set to the ON signal and sets the first control signal Sb1 to an OFF signal. In this way, during a second time period T2 from the first time point t1 to the second time point t2, both the switching devices Q1 and Q2 are on, and the bidirectional switch 2 is in the bidirectionally on state. Thus, during the second time period T2, electric power is supplied from the AC power supply 8 via the bidirectional switch 2 to the load 7, and the load 7 therefore emits light.

A third time point t3 is a time point earlier than an end time point (a zero crossing point) t4 of the half period by a definite time (e.g., 300 μs). That is, when it is assumed that the end time point t4 is a time point at which a time obtained by subtracting the first time period T1 from a time corresponding to the half period has elapsed since the first time point t1 serving as the generation time point of the first detection signal ZC1, the third time point t3 is a time point earlier than the end time point t4 by a definite time period. Note that in the timing chart of FIG. 2, the third time point t3 is illustrated to coincide with a timing at which the AC voltage Vac reaches a positive specified value Vzc or a timing at which the AC voltage Vac reaches a negative specified value −Vzc, but the third time point t3 is determined regardless of the timing at which the AC voltage Vac becomes equal to the positive specified value Vzc or the negative specified value −Vzc.

At the third time point t3, the controller 6 sets the first control signal Sb1 and the second control signal Sb2 to OFF signals. In this way, during a third time period T3 from the second time point t2 to the third time point t3, only the switching device Q1 of the switching devices Q1 and Q2 is off, and the bidirectional switch 2 is in a reverse on state. Thus, during the third time period T3, supplying of electric power from the AC power supply 8 to the load 7 is interrupted.

During a fourth time period T4 from the third time point t3 to the end time point (zero crossing point) t4 of the half period, both the switching devices Q1 and Q2 are off, and the bidirectional switch 2 is in the bidirectionally off state.

Moreover, the operation of the lighting control device 1 during the negative half period of the AC voltage Vac is substantially the same as that during the positive half period.

In the negative half period, when the AC voltage Vac reaches the negative specified value −Vzc, the second detector 32 outputs the second detection signal ZC2. In the present embodiment, a first time period T1 is a time period from a starting point t0 (t4) of the negative half period to a first time point t1 which is a generation time point of the second detection signal ZC2. Moreover, the second time point t2 is a time point when the on time having a length according to the dimming signal elapses from the first time point t1. The third time point t3 is a time earlier than the end time point t4 (t0) of the half period by a definite time period (e.g., 300 μs).

During the first time period T1, the controller 6 controls such that the first control signal Sb1 and the second control signal Sb2 are OFF signals. Thus, the bidirectional switch 2 is in the bidirectionally off state during the first time period T1. Then, at the first time point t1, the controller 6 sets the first control signal Sb1 and second control signal Sb2 to the ON signals. In this way, during a second time period T2 from the first time point t1 to the second time point t2, both the switching devices Q1 and Q2 are on, and the bidirectional switch 2 is in the bidirectionally on state. Thus, during the second time period T2, electric power is supplied from the AC power supply 8 via the bidirectional switch 2 to the load 7, and the load 7 therefore emits light.

At the second time point t2, the controller 6 keeps the first control signal Sb1 set to the ON signal and sets the second control signal Sb2 to an OFF signal. At the third time point t3, the controller 6 sets the first control signal Sb1 and the second control signal Sb2 to OFF signals. In this way, during a third time period T3 from the second time point t2 to a third time point t3, only the switching device Q2 of the switching devices Q1 and Q2 is off, and the bidirectional switch 2 is in the reverse on state. Thus, during the third time period T3, supplying of electric power from the AC power supply 8 to the load 7 is interrupted. During the fourth time period T4 from the third time point t3 to the end time point t4 of the half period, both the switching devices Q1 and Q2 are OFF, and the bidirectional switch 2 is in the bidirectionally off state.

The lighting control device 1 of the present embodiment alternately repeats the operation during the positive half period and the operation during the negative half period in every half period of the AC voltage Vac which are described above to dim the load 7. In the present embodiment, since the bidirectionally on state is the on state, and the reverse on state is the off state, a time point at which the bidirectional switch 2 is switched from the bidirectionally on state to the reverse on state, that is, the second time point t2 corresponds to the switching time point. Since the time (the on time) from the first time point t1 to the switching time point (the second time point t2) is a time according to the dimming level input to the inputter 4, a time when the input terminals 11 and 12 are conductive during the half period is to be determined in accordance with the dimming level. Moreover, when the positive specified value Vzc and the negative specified value −Vzc are fixed values, a time from the starting point t0 to the first time point (the generation time point of the first detection signal ZC1 or the second detection signal ZC2) t1 of the half period has a substantially fixed length.

Thus, a variable time, which is defined as a time from the starting point t0 to the switching time point (the second time point t2) of the half period, that is, a sum of the first time period T1 and the on time (the second time period T2) having a length which is variable according to the dimming level, has a length that varies in accordance with the dimming level. In other words, the variable time is a time having a variable length, and the phase of the AC voltage Vac at the switching time point (the second time point t2) varies in accordance with the dimming level. That is, in order to achieve a small light output of the load 7, the variable time is set short, whereas in order to achieve a large light output of the load 7, the variable time is set long. Thus, it is possible to vary the magnitude of the light output of the load 7 in accordance with the dimming level input to the inputter 4.

Moreover, during the latter part of the half period of the AC voltage Vac, specifically, during the time periods (the third time period T3 and the fourth time period T4) from the switching time point (the second time point t2) to the end time point t4 of the half period, the bidirectional switch 2 is in the off state (in the reverse on state or in the bidirectionally off state). In the present embodiment, a time period which is a sum of the third time period T3 and the fourth time period T4 corresponds to the off-time period. The lighting control device 1 can secure supplying electric power from the AC power supply 8 to the power supply 5 during the off-time period. Moreover, the bidirectional switch 2 is in the off state also during a time period from the starting point (zero crossing point) t0 to the first time point t1 of the half period. Thus, when attention is focused on two consecutive half periods, the bidirectional switch 2 is in the off state from the second time point t2 of the first half period to the first time point t1 of the next half period (i.e., the second half period).

In this embodiment, the expression "from a time point A" includes the time point A. For example, "from a first time point" includes the first time point. On the other hand, the expression "to a time point A" excludes the time point A and means "until immediately before the time point A". For example, "to an end time point of a half period" excludes the end time point of the half period and means "until immediately before the end time point of the half period".

(1.2.3) Operation of Corrector

Next, operation of the corrector 61 will be described with reference to FIG. 2. In this embodiment, the dimming level is set to its maximum (in the present embodiment, 97%).

In the present embodiment, the corrector 61 determines that the target waveform has an anomaly when the zero crossing point of the AC voltage Vac is not regularly detected, and the corrector 61 corrects the prescribed range to narrow the prescribed range. In the example shown in FIG. 2, while the zero crossing point is regularly detected, that is, while the first detection signal ZC1 and the second detection signal ZC2 are input to the controller 6 regularly (every half period), the upper limit value of the on time is Ton1. Thus, the controller 6 retains the bidirectional switch 2 in the ON state from the first time point t1 for an on time of Ton1.

On the other hand, when the zero crossing point is no longer regularly detected, that is, the first detection signal ZC1 and the second detection signal ZC2 are no longer input to the controller 6 regularly (every half period), the corrector 61 determines that the target waveform includes an anomaly. In this case, the corrector 61 changes the upper limit value of the on time from Ton1 to Ton2. Ton2 is smaller than Ton1 (Ton1>Ton2). That is, when and after it is determined that the target waveform has an anomaly, the upper limit value of the on time is Ton2. Thus, the controller 6 controls the bidirectional switch 2 to retain the bidirectional switch 2 in the ON state from the first time point t1 for an on time of Ton2. Thus, even when the dimming level remains its maximum (in the present embodiment, 97%), the on time is reduced, and therefore, the light output of the load 7 is reduced, and the dimming level is apparently reduced.

In FIG. 2, the symbol "x" added to the first detection signal ZC1 denotes that the zero crossing point is not detected.

(1.3) Advantages

The lighting control device 1 of the present embodiment includes the corrector 61, and thus, when the target waveform has an anomaly, the corrector 61 corrects the prescribed range so as to narrow the prescribed range, which enables the load 7 to continuously emit light. In some types of loads 7, for example, when the on time is set to the upper limit value, the power supply 5 cannot ensure the control electric power, and supplying of electric power from the power supply 5 to the controller 6 can no longer be maintained, which may cause an anomalous operation, for example, blinking or flickering of the loads 7. In some types of loads 7, for example, when the on time is set to the lower limit value, electric power is not supplied to the loads 7, which may cause an anomalous operation, for example, blinking or flickering of the loads 7. When such an anomalous operation of the load 7 occurs, any anomaly of the target waveform is observed in many cases. Thus, the corrector 61 detects such an anomaly to narrow the prescribed range. In this way, the lighting control device 1 of the present embodiment can reduce anomalous operations such as blinking and flickering of the load 7 which occur when the on time is set to the upper limit value or the lower limit value. Thus, the lighting control device 1 of the present embodiment becomes compatible with an increased number of types of loads.

Moreover, examples of a control method of the lighting control device include a normal phase control method (leading edge method) in addition to a reverse phase control method (trailing edge method). The normal phase control method establishes conduction between the pair of input terminals 11 and 12 during a time period from a time point during the half period of the AC voltage Vac to the zero crossing point. In the reverse phase control method, the load 7 including an LED element serving as a light source is started to be supplied with electric power from the zero crossing point, and therefore, it is possible to reduce current waveform distortion at the start of the electric power supply. Thus, the number of loads 7 (lamps) connectable to the lighting control device increases, and the generation of a howling sound can be reduced.

While the lighting control device 1 of the present embodiment basically adopts the reverse phase control method, the load 7 is started to be supplied with electric power at the first time point (the generation time point of the first detection signal ZC1 or the second detection signal ZC2) t1 slightly later than the starting point (zero crossing point) t0 of the half period. Thus, the current waveform distortion may be larger than that in the reverse phase control method in which the load 7 is started to be supplied with electric power at the zero crossing point. However, the absolute value of the AC voltage Vac at the first time point t1 is not very large, and therefore, the influence of the current waveform distortion is negligibly small.

Moreover, as described in the present embodiment, the lighting control device 1 preferably further includes the storage 62 configured to store the prescribed range, and the corrector 61 is preferably configured to store the corrected prescribed range in the storage 62. With this configuration, the prescribed range corrected by the corrector 61 is stored in the storage 62, and thus, once the corrector 61 corrects the prescribed range, it is possible to continuously adopt the corrected prescribed range. Thus, with the lighting control device 1, it is possible to continuously reduce anomalous operations such as blinking and flickering of the load 7. Note that the storage 62 is not an essential component of the lighting control device 1, and thus, the storage 62 may accordingly be omitted.

Moreover, as described in the present embodiment, the prescribed range is preferably defined by the upper limit value and the lower limit value, and the corrector 61 is preferably configured to change at least one of the upper limit value and the lower limit value to correct the prescribed range. This configuration enables the corrector 61 to correct the prescribed range by a relatively simple process of changing at least one of the upper limit value and the lower limit value. Note that defining the prescribed range by the upper limit value and the lower limit value is not an essential configuration of the lighting control device 1. For example, the prescribed range may be defined by a range from the lower limit value to the upper limit value and the upper limit value.

Moreover, as described in the present embodiment, the lighting control device 1 preferably further includes the phase detector 3 configured to output a detection signal to the corrector 61 when the phase detector 3 detects a zero crossing point of the AC voltage Vac. The target waveform is preferably a voltage waveform. In this case, a determination condition is preferably that the detection signal is regularly input from the phase detector 3 to the corrector 61, and the corrector 61 is preferably configured to determine that the target waveform has the anomaly when the detection signal is irregularly input to the corrector 61. With this configuration, anomalous operations such as blinking and flickering of the load 7 can be simply and accurately determined in accordance with the zero crossing point of the AC voltage Vac. Note that it is not an essential configuration of the lighting control device 1 that the target waveform is the voltage waveform. For example, the target waveform may be a current waveform. Moreover, also when the target waveform is the voltage waveform, the corrector 61 may determine whether or not the target waveform has an anomaly in accordance with, for example, a waveform analysis, instead of the zero crossing point of the AC voltage Vac.

(1.4) Variation (1.4.1) First Variation

Figure 3:
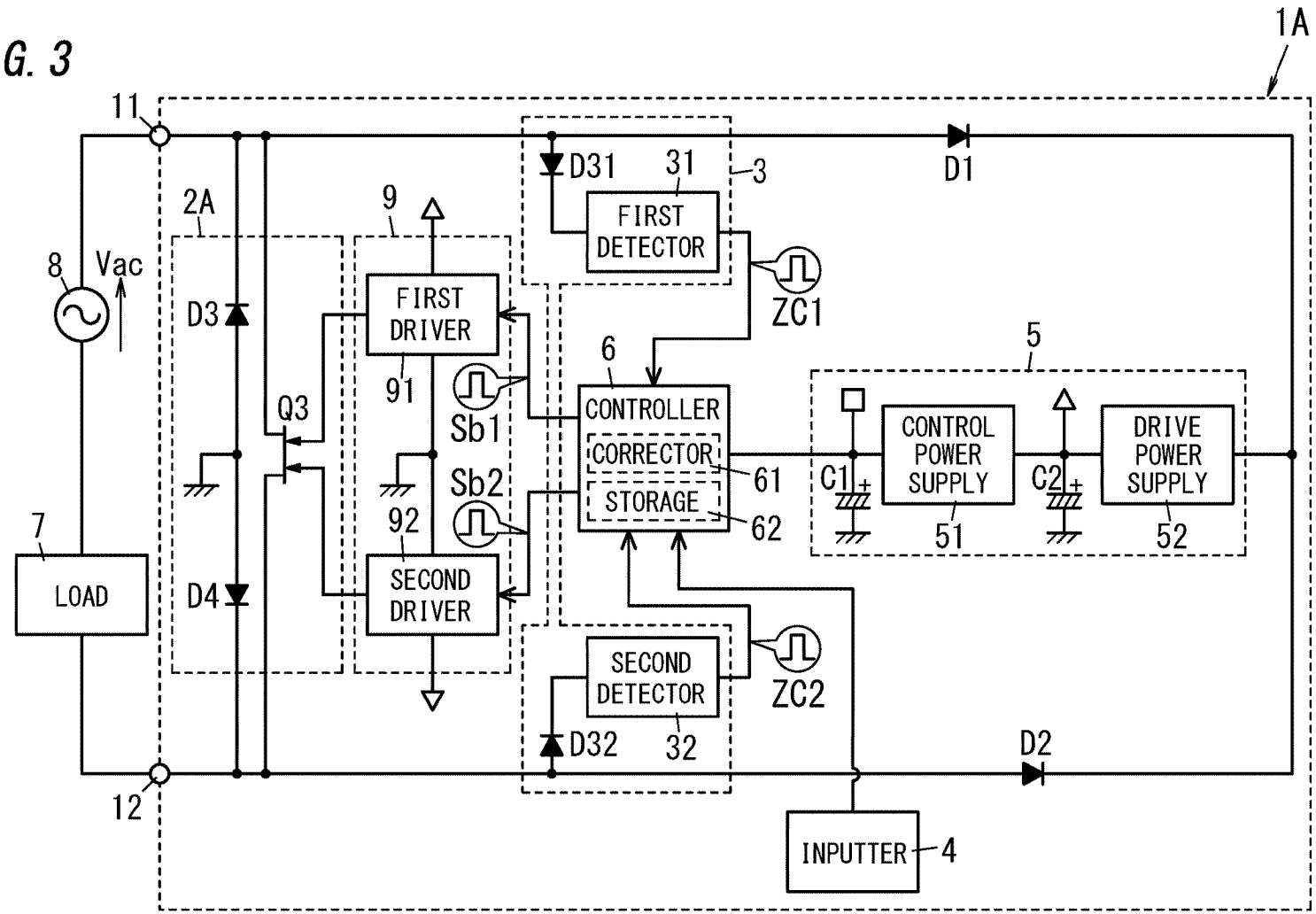
FIG. 3 is a circuit diagram schematically illustrating a configuration of a lighting control device according to a first variation of the first embodiment.

As illustrated in FIG. 3, a bidirectional switch 2A of a lighting control device 1A according to a first variation of the first embodiment is different from the bidirectional switch 2 of the lighting control device 1 of the first embodiment. Components similar to those in the first embodiment are hereinafter denoted by the same reference signs as those in the first embodiment, and the description thereof will be omitted accordingly.

In the present variation, the bidirectional switch 2A includes a switching device Q3 having a double gate structure. The switching device Q3 is a semiconductor element having a double gate (dual gate) structure including a semiconductor material of a wide band gap such as gallium nitride (GaN). Moreover, the bidirectional switch 2A includes a pair of diodes D3 and D4 connected to each other in a so-called anti-series connection between input terminals 11 and 12. The cathode of the diode D3 is connected to the input terminal 11, and the cathode of the diode D4 is connected to the input terminal 12. The anodes of both the diodes D3 and D4 are electrically connected to ground of a power supply 5. In the present variation, the pair of diodes D3 and D4 and a pair of diodes D1 and D2 together form a diode bridge.

According to the configuration of the present variation, the bidirectional switch 2A can reduce the conduction loss more than the bidirectional switch 2.

(1.4.2) Other Variations

Variations of the first embodiment other than the above-described first variation will be mentioned below.

The lighting control device of each of the first embodiment and the first variation is applicable not only to the load 7 using an LED device as a light source but also to a light source including a capacitor input-type circuit, having a high impedance, and being lit with a small current. Examples of such a light source include an organic electroluminescence (EL) element. Moreover, the lighting control device is applicable to loads 7 of various light sources such as a discharge lamp.

The bidirectional switch 2 can be controlled so as to be in a forward ON state instead of the bidirectionally ON state, or the bidirectional switch 2 can be controlled so as to be in the bidirectionally ON state instead of the forward ON state. Moreover, the bidirectional switch 2 can be controlled so as to be in the reverse ON state instead of the bidirectionally OFF state, or the bidirectional switch 2 can be controlled so as to be in the bidirectionally OFF state instead of the reverse ON state. That is, it is only required that the ON state or the OFF state of the bidirectional switch 2 is not changed from the states described in the above description.

Moreover, a control method of the bidirectional switch 2 by the controller 6 is not limited to the above-described examples and may be, for example, a method for alternately setting the first control signal and the second control signal to the ON signal at the same cycle as the AC voltage Vac. In this case, the bidirectional switch 2 is conductive during a time period during which one of the switching devices Q1 and Q2 corresponding to a high-potential side of the AC voltage Vac is on. That is, this variation realizes so-called reverse phase control for establishing conduction between the pair of input terminals 11 and 12 during a time period from the zero crossing point of the AC voltage Vac to a time point during the half period. In this case, a phase difference between the first control signal and the AC voltage Vac and a phase difference between the second control signal and the AC voltage Vac are controlled to adjust the on time of the bidirectional switch 2.

Moreover, the control method of the bidirectional switch 2 is not limited to the reverse phase control method (trailing edge method) but may be a normal phase control method (leading edge method).

When the control method of the bidirectional switch 2 is a normal phase control method, the controller 6 turns on the bidirectional switch 2 at a time point when the OFF time having a length according to the dimming signal elapses from the starting point (zero crossing point) of the half period during the half period of the AC voltage Vac. Moreover, the controller 6 turns off the bidirectional switch 2 at a time point when a time obtained by subtracting a definite time period from the time of the half period elapses from the starting point of the half period. That is, in the normal phase control method, the bidirectional switch 2 is in the on state from a time point when the OFF time corresponding to the dimming signal elapses from the starting point of the half period of the AC voltage Vac until immediately before the end time point (zero crossing point) of the half period. In other words, the bidirectional switch 2 is in the off state during a time period from a point immediately before the zero crossing point of the AC voltage Vac to a time point when a time obtained by adding a definite time period to the OFF time having a length according to the dimming signal elapses.

Moreover, it is only required that the prescribed range is eventually narrowed, and therefore, the configuration of the corrector 61 is not limited to a configuration of correcting the on time to directly narrow the prescribed range but may be, for example, a configuration of correcting the dimming level to indirectly narrow the prescribed range. In this case, the corrector 61 converts the upper limit value of the prescribed range into an upper limit value (hereinafter referred to "converted upper limit value") of the dimming level. For example, the corrector 61 obtains a value corresponding to the dimming level from the dimming signal input from the inputter 4 to the controller 6, and when this value exceeds the converted upper limit value, the corrector 61 corrects the dimming level to the converted upper limit value so as to indirectly reduce the upper limit value of the prescribed range.

Alternatively, the corrector 61 may be configured, for example, to change the correspondence between the dimming level and the on time so as to indirectly narrow the prescribed range. In this case, for example, the corrector 61 selects, from a plurality of tables including different upper limit values of the on time, a table to which the corrector 61 refers to obtain the on time from the dimming level in accordance with the upper limit value of the prescribed range. That is, each table has a different upper limit value of the on time, and the corrector 61 switches between the tables to be used, thereby indirectly changing the upper limit value of the prescribed range.

Moreover, as long as the corrector 61 corrects at least one of the upper limit value and the lower limit value which define the prescribed range, the configuration of the corrector 61 is not limited to the configuration of the first embodiment in which only the upper limit value is corrected. That is, the corrector 61 may be configured to correct only the lower limit value or may be configured to correct both the upper limit value and the lower limit value.

Moreover, a timing at which the upper limit value and the lower limit value of the storage 62 are reset to the default values is not limited to a timing at which the dimming level transitions to the OFF level. The timing at which the upper limit value and the lower limit value of the storage 62 are reset to the default values may be, for example, a time point when a predetermined time elapses from the correction of the prescribed range by the corrector 61. In this case, when the corrector 61 corrects the prescribed range, the corrected prescribed range is adopted until the predetermined time elapses, and when and after the predetermined time elapses, the prescribed range before the correction is adopted.

Moreover, according to the configuration of the first embodiment, when the target waveform has an anomaly, the prescribed range of the on time is narrowed, thereby reducing an adjustable range of the light output of the load 7 and a range in which the dimming level is selectable is also narrowed apparently. Thus, for the manipulation section manipulated by a user, a configuration including neither upper limit nor lower limit of the movable range as in the case of, for example, a rotary encoder is preferred to a configuration including the upper limit and the lower limit of the movable range as in the case of a variable resistor. In this case, a user manipulates the manipulation section without taking the upper limit and the lower limit of the dimming level into consideration. Thus, even when the range in which the dimming level is selectable is narrowed, apparent feeling that something is different is less likely to be aroused.

Moreover, the switch driver 9 is not an essential configuration of the lighting control device 1 and may thus accordingly be omitted. When the switch driver 9 is omitted, the controller 6 directly drives the bidirectional switch 2. When the switch driver 9 is omitted, the drive power supply 52 is omitted.

Moreover, each of the switching devices Q1 and Q2 included in the bidirectional switch 2 is not limited to an enhancement n-channel MOSFET but may be, for example, an insulated gate bipolar transistor (IGBT). Moreover, in the bidirectional switch 2, rectifier elements (the diodes) for realizing the unidirectionally on state are not limited to the parasitic diodes of the switching devices Q1 and Q2 but may be external diodes such as those described in the first variation. The diode may be accommodated in an identical package with each of the switching devices Q1 and Q2.

Moreover, the first time point t1 is not limited to the generation time point of the first detection signal ZC1 or the second detection signal ZC2 but may be a time point when a defined delay time (e.g., 300 μs) elapses from the generation time point of the first detection signal ZC1 or the second detection signal ZC2. The delay time is not limited to 300 μs but may be accordingly determined within a range from 0 μs to 500 μs.

Moreover, the third time point t3 is required only to be earlier than the end time point (zero crossing point) t4 of the half period, and the length from the third time point t3 to the end time point t4 of the half period can be accordingly determined. For example, when the time length from the first time point t1 to the third time point t3 is shorter than the half period by a certain specified time, the specified time is not limited to 300 μs but may be accordingly set to a value within a range from 100 μs to 500 μs.

Figure 4:
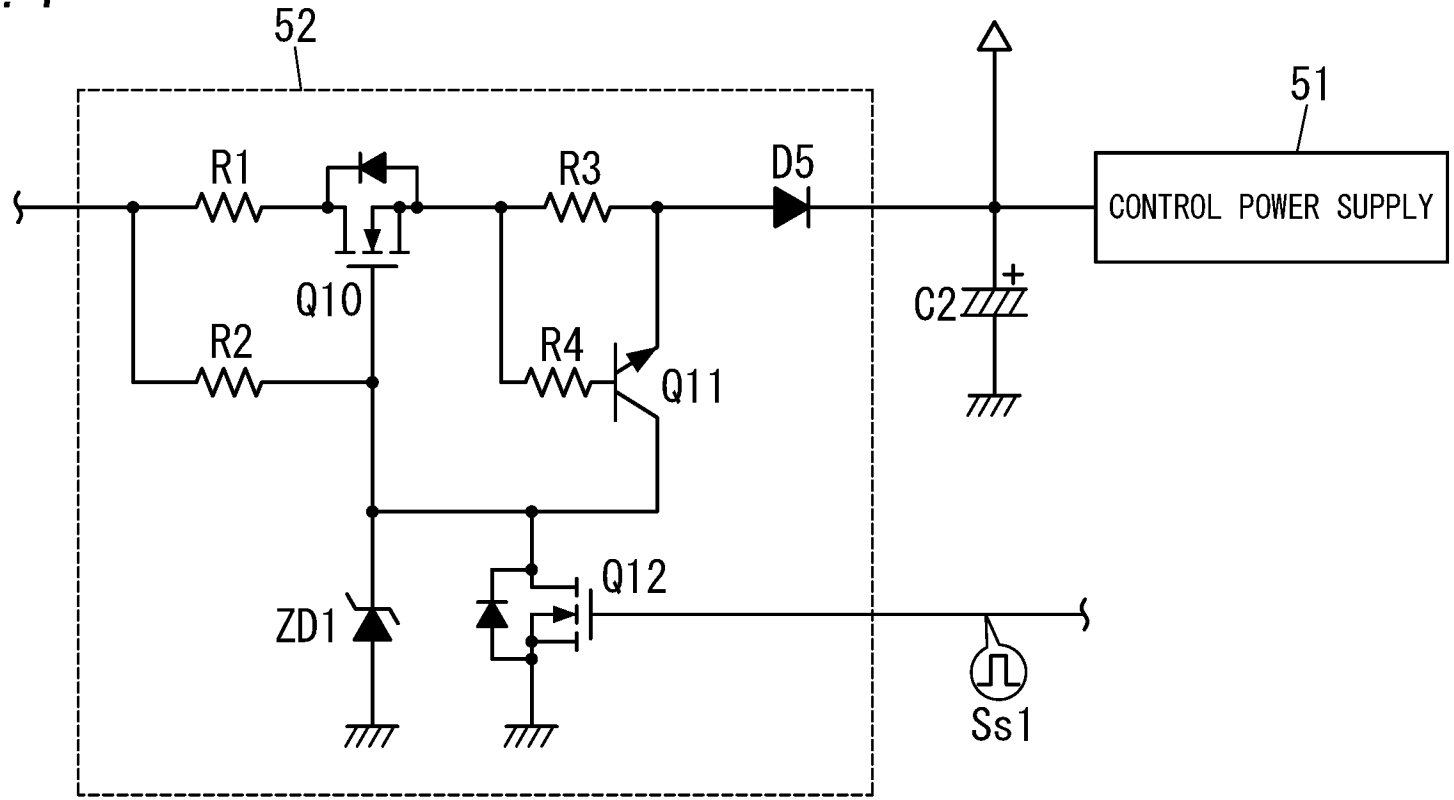
FIG. 4 is a circuit diagram schematically illustrating a configuration of a power supply of a lighting control device according to another variation of the first embodiment.

FIG. 4 shows an example of a configuration configured to halt generation of the control electric power by the power supply 5. In the example shown in FIG. 4, the drive power supply 52 forms a constant voltage circuit including a Zener diode ZD1 and a transistor Q10. In FIG. 4, the drive power supply 52 includes the Zener diode ZD1, the transistor Q10, a resistor R1 (first resistor R1), a resistor R2 (second resistor R2), and a diode D5. The drive power supply 52 further includes a resistor R3 (third resistor R3), a fourth resistor R4, a third switching device Q11, and a fourth switching device Q12. In FIG. 4, the right and left sides of FIG. 1 are reversed, and the drive power supply 52 is located on the left of the control power supply 51.

Specifically, the resistor R1, the transistor Q10, the resistor R3, the diode D5, and the capacitive element C2 are electrically connected in series between the power supply input terminal (the connection point of the pair of diodes D1 and D2) and ground. The resistor R2 and the Zener diode ZD1 are electrically connected in series between the power supply input terminal and ground. Each of the transistor Q10 and the switching device Q12 includes, for example, an enhancement n-channel MOSFET. The switching device Q11 includes, for example, an npn-bipolar transistor.

The transistor Q10 has a gate electrically connected to the cathode of the Zener diode ZD1. The Zener diode ZD1 has an anode electrically connected to ground. The switching device Q11 is electrically connected between the source and the gate of the transistor Q10. The switching device Q11 has an emitter electrically connected to the source of the transistor Q10 via the resistor R3. The switching device Q11 has a base electrically connected to the source of the transistor Q10 via the resistor R4. The switching device Q12 is electrically connected between the gate of the transistor Q10 and the ground. The switching device Q12 has a gate electrically connected to the controller 6. The switching device Q12 receives an interruption signal Ss1 output from the controller 6 to be turned on and off.

With this configuration, while the interruption signal Ss1 from the controller 6 is the OFF signal (e.g., a low level), the drive power supply 52 is supplied with electric power from the AC power supply 8 to charge the capacitive element C2 with a constant voltage based on the Zener voltage (breakdown voltage) of the Zener diode ZD1. A voltage between the gate of the transistor Q10 and the ground is clamped to the Zener voltage of the Zener diode ZD1. In this embodiment, when the value of a current (drain current) flowing through the transistor Q10 becomes larger than or equal to a specified value, a voltage across the resistor R3 turns on the switching device Q11, thereby turning off the transistor Q10. At this time, the charging path of the capacitive element C2 is interrupted, so that the power supply 5 stops generating the control electric power. That is, when the charging path of the capacitive element C2 is interrupted, the voltage of the capacitive element C2 only decreases, and therefore, the voltage of the capacitive element C2 decreases below a voltage at which the control power supply 51 can operate, so that the control power supply 51 stops generating the control electric power.

On the other hand, when the interruption signal Ss1 from the controller 6 transitions to the ON signal (e.g., a high level), the switching device Q12 is turned on, thereby turning off the transistor Q10. At this time, the charging path of the capacitive element C2 is interrupted. Note that when the bidirectional switch 2 is in the OFF state, the interruption signal Ss1 is the OFF signal, and the drive power supply 52 charges the capacitive element C2.

The diodes D1 and D2 in the first embodiment are not essential components of the lighting control device 1, and the diodes D1 and D2 may thus accordingly be omitted.

Moreover, in comparison between two values, for example, in relation to the on time and the lower limit value, "larger than or equal to" includes both a case where the two values are equal to each other and a case where one of the two values is larger than the other of the two values. However, the meaning of the "larger (higher) than or equal to" mentioned herein is not limited to the above definition but "larger (higher) than or equal to" mentioned herein may be a synonym of "larger (higher) than" which includes only a case where one of the two values is larger than the other of the two values. That is, whether or not a case where the two values are equal to each other is included can be arbitrarily changed depending on the setting of the lower limit value and the like, and therefore, there is no technical difference between "larger (higher) than or equal to" and "larger (higher) than". Similarly, "lower than" may be a synonym of "lower than or equal to".

Second Embodiment

Figure 5:
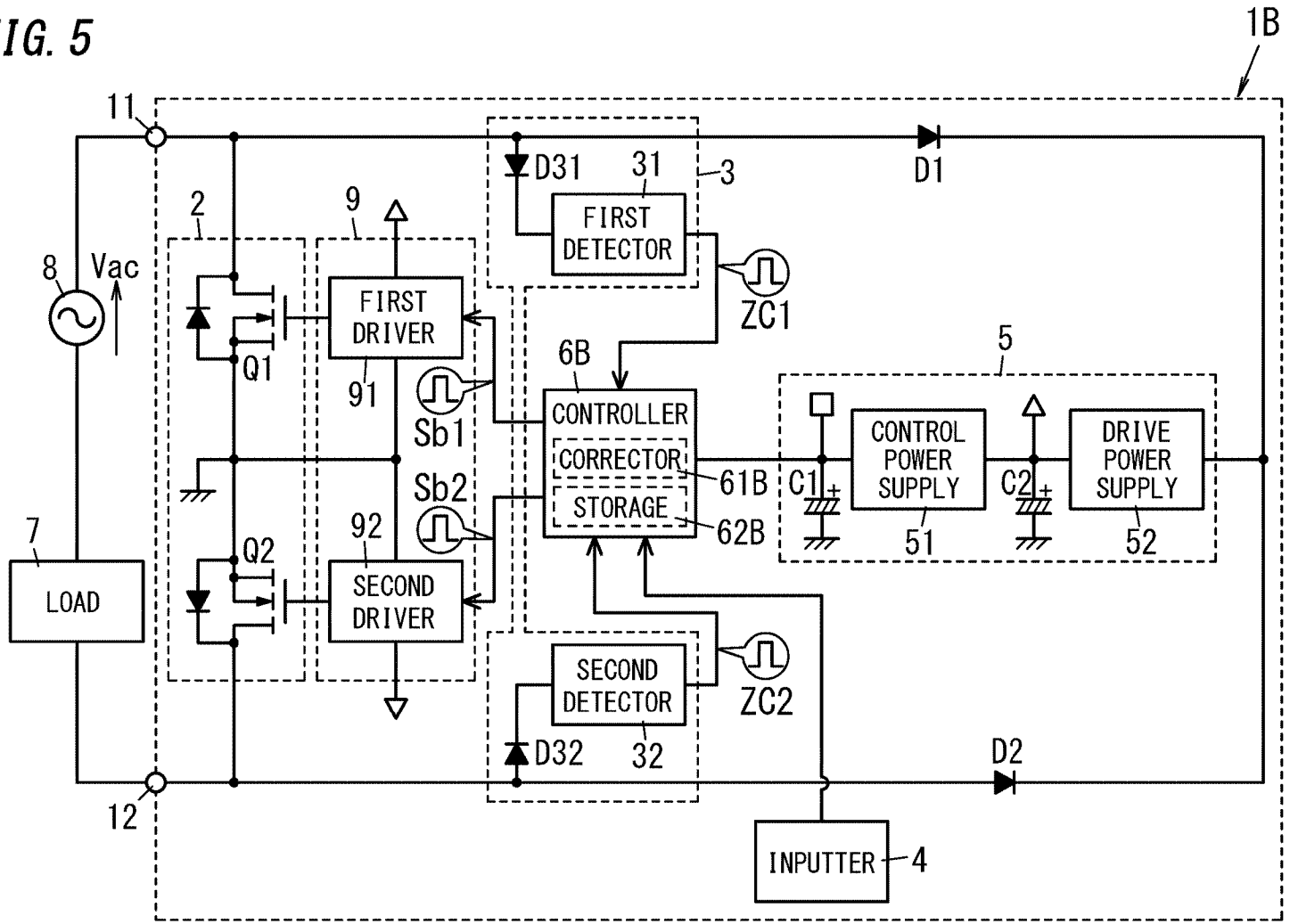
FIG. 5 is a circuit diagram schematically illustrating a configuration of a lighting control device according to a second embodiment.
Figure 6:
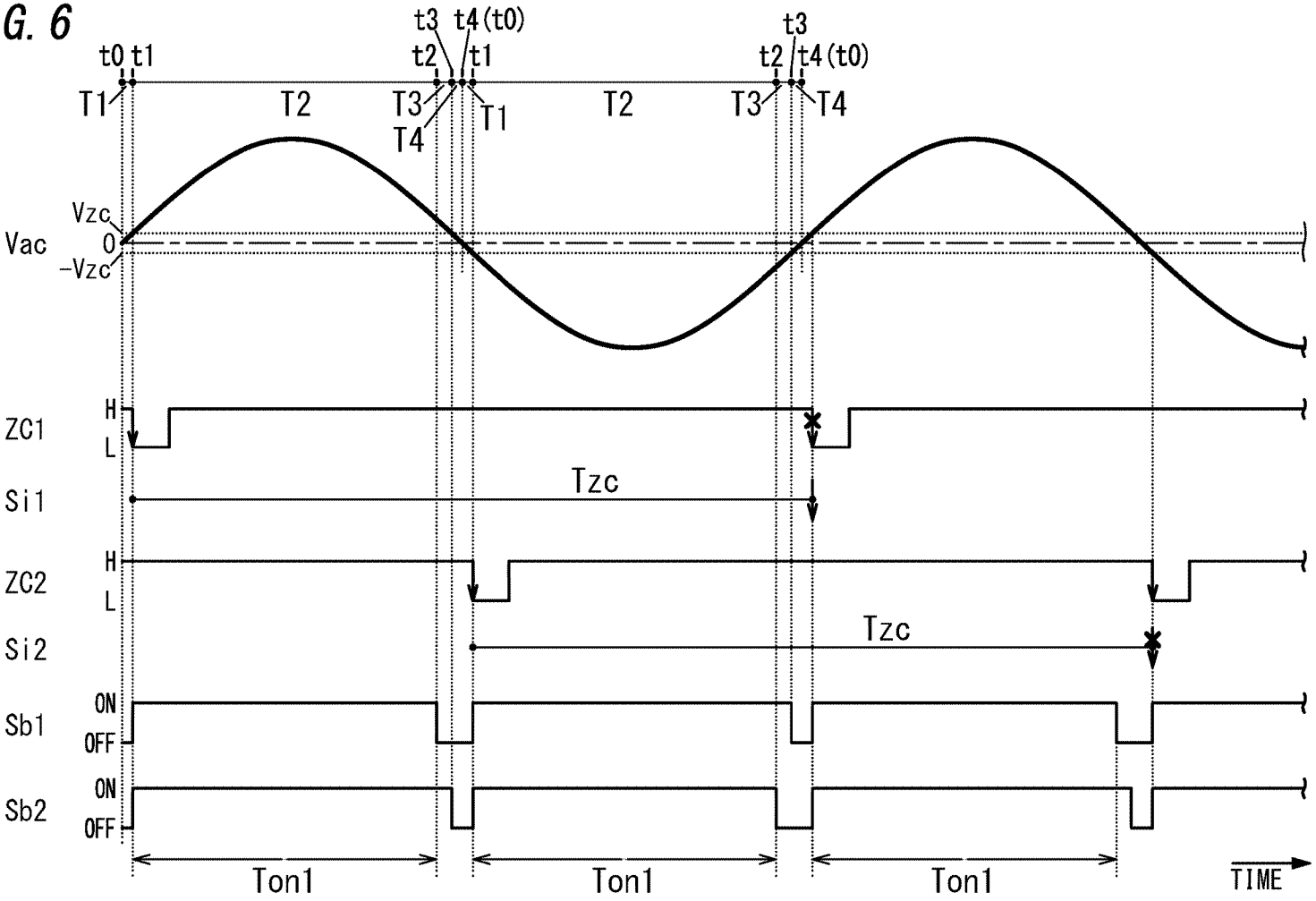
FIG. 6 is a timing chart illustrating operation of the lighting control device according to the second embodiment.

As illustrated in FIGS. 5 and 6, a lighting control device 1B of a second embodiment is different from the lighting control device 1 of the first embodiment in that a controller 6B is configured to estimate a zero crossing point of an AC voltage Vac of at least one half period ahead in future in accordance with a detection signal of a zero crossing point for one time. The circuit configuration of the lighting control device 1B is the same as that of the lighting control device 1 of the first embodiment. Components similar to the components of the first embodiment will be hereinafter denoted by the same reference signs as those in the first embodiment, and the description thereof will be omitted.

A phase detector 3 is configured to output a detection signal to a corrector 61B and the controller 6B when the phase detector 3 detects the zero crossing point of the AC voltage Vac. The corrector 61B and storage 62B of the present embodiment respectively correspond to the corrector 61 and the storage 62 of the first embodiment.

In the present embodiment, the controller 6B estimates, based on the frequency of the AC voltage Vac, a zero crossing point of the AC voltage Vac of at least half period ahead in future as a virtual zero crossing point each time the controller 6B receives the detection signal from the phase detector 3, and the controller 6B generates a virtual signal at the timing of the virtual zero crossing point. Specifically, as illustrated in FIG. 6, the controller 6B generates a first virtual signal Si1 at a time point when a stand-by time Tzc corresponding to one period of the AC voltage Vac elapses from a time at which the controller 6B receives a first detection signal ZC1. Similarly, the controller 6B generates a second virtual signal Si2 at a time point when the stand-by time Tzc corresponding to the one period of the AC voltage Vac elapses from a time point at which the controller 6B receives a second detection signal ZC2. FIG. 6 shows the AC voltage Vac, the first detection signal ZC1, the second detection signal ZC2, a first control signal Sb1, and a second control signal Sb2 which are similar to those of FIG. 2. FIG. 6 further shows the first virtual signal Si1 and the second virtual signal Si2.

In this embodiment, to prevent generation of the first virtual signal Si1 earlier than a next first detection signal ZC1, the stand-by time Tzc is set slightly longer than the one period of the AC voltage Vac. Moreover, to prevent generation of the second virtual signal Si2 earlier than a next second detection signal ZC2, the stand-by time Tzc is set a little longer than the one period of the AC voltage Vac.

The controller 6B uses the logical disjunction of the first detection signal ZC1 and the first virtual signal Si1 as a trigger signal for determining a timing for controlling a bidirectional switch 2. Similarly, the controller 6B uses the logical disjunction of the second detection signal ZC2 and the second virtual signal Si2 as a trigger signal for determining a timing for controlling the bidirectional switch 2. Thus, even when the phase detector 3 fails to detect the zero crossing point, the controller 6B can determine a timing for controlling the bidirectional switch 2 by using the virtual signal generated at the virtual zero crossing point as the trigger signal instead of the detection signal from the phase detector 3.

Moreover, in the present embodiment, the corrector 61B determines whether or not the zero crossing point of the AC voltage Vac is regularly detected based on both the zero crossing point detected by the phase detector 3 and the zero crossing point (virtual zero crossing point) estimated by the controller 6B. That is, a determination condition which the corrector 61B refers to is that at least one of the detection signal from the phase detector 3 and the virtual signal from the controller 6B is regularly input to the corrector 61B. The corrector 61B is configured to determine that the target waveform has an anomaly when either one of the detection signal and the virtual signal is irregularly input to the corrector 61B. Thus, when at least one of the detection signal and the virtual signal is generated, the corrector 61B determines that the zero crossing point is detected. Thus, as illustrated in FIG. 6, when the phase detector 3 fails to detect the zero crossing point, the corrector 61B does not immediately determine that the target waveform has an anomaly, but the upper limit value of the on time remains Ton1. Note that when the detection signal is not input but only the virtual signal is input in succession for a specified number of times, the corrector 61B may determine that the target waveform has an anomaly.

The controller 6B may be configured to estimate the virtual zero crossing point for two or more times in response to the detection signal of the zero crossing point for one time. In this case, the controller 6B generates a virtual signal every lapse of the stand-by time Tzc from a time point at which the controller 6B receives the detection signal.

Moreover, the stand-by time Tzc for generating the virtual signal is at least determined with reference to the half period of the AC voltage Vac. The stand-by time Tzc may be determined with reference to the half period, three times the half period, four times the half period, or more times other than the one time period. Three times the half period equals 1.5 periods, and four times the half period equals 2 periods. When the stand-by time Tzc is determined with reference to a period of an odd multiple of the half period, the controller 6B generates the second virtual signal Si2 at a time point when the stand-by time Tzc elapses based on the first detection signal ZC1. Moreover, in this case, the controller 6B generates the first virtual signal Si1 at a time point when the stand-by time Tzc based on the second detection signal ZC2 elapses. Thus, the controller 6B may be configured to generate the first virtual signal Si1 and the second virtual signal Si2 based on only one of the first detection signal ZC1 and the second detection signal ZC2.

The lighting control device 1B of the present embodiment includes the phase detector 3 configured to output a detection signal to the corrector 61B and the controller 6B when the phase detector 3 detects a zero crossing point of the AC voltage Vac. The controller 6B is configured to estimate a zero crossing point of the AC voltage Vac of at least the half period ahead in future based on the detection signal for one time to obtain a virtual zero crossing point, and to generate a virtual signal at the virtual zero crossing point. Moreover, the determination condition is that at least one of the detection signal and the virtual signal is regularly input to the corrector 61B, and the corrector 61B is configured to determine that the target waveform has the anomaly when either one of the detection signal and the virtual signal is irregularly input to the corrector 61B. Thus, even when the phase detector 3 cannot detect a zero crossing point due to the influence of accidental noise and the like, or even when the zero crossing point is shifted due to an instantaneous drop of the AC voltage Vac or the like, the controller 6B stably performs reverse phase control in synchrony with the period of the AC voltage Vac. Moreover, even when the phase detector 3 fails to detect the zero crossing point, the corrector 61B does not immediately determine that the target waveform has an anomaly, but it becomes possible to reduce frequent corrections of the prescribed range.

Other configurations and functions are similar to those of first embodiment. The components of the present embodiment can be used in combination with each component described in the first embodiment (including variations).

OTHER EMBODIMENTS

In each of the first embodiment (including the variations) and the second embodiment, supplying electric power from the AC power supply 8 to the power supply 5 is secured (during the third time period T3 and the fourth time period T4) before the start time point (zero crossing point) t0 of the half period of the AC voltage Vac, but the above-described embodiments are not limited to this configuration.

Supplying electric power from the AC power supply 8 to the power supply 5 may be secured for a definite time (during the first time period T1) after the start time point (zero crossing point) t0 of the half time period of the AC voltage Vac. During periods (the first time period T1, the third time period T3, and the fourth time period T4) before and after the starting point (zero crossing point) t0 of the half period of the AC voltage Vac, supplying electric power from the AC power supply 8 to the power supply 5 may be secured for a definite time. That is, supplying electric power from the AC power supply 8 to the power supply 5 can be secured during any of the first time period T1, the third time period T3, and the fourth time period T4. Note that when a user manipulates the manipulation section so as to maximize the light output of the load 7, priority is given to securing the first time period T1, the third period T3, and the fourth time period T4, and the second time period T2 may be controlled to be a time period shorter than a length at which the light output is maximized.

Determining the definite time so as to sufficiently supply electric power from the AC power supply 8 to the power supply 5 enables the controller 6 to stably operate while waveform distortion is reduced.

REFERENCE SIGNS LIST

1, 1A, 1B Lighting Control Device
2, 2A Bidirectional Switch
3 Phase Detector
4 Inputter
6, 6B Controller
7 Load (Illumination Load)
8 AC Power Supply
11 Input Terminal
12 Input Terminal
61, 61B Corrector
62, 62B Storage
Si1 First Virtual Signal
Si2 Second Virtual Signal
T0 Starting Point (Zero Crossing Point) of Half Period
T4 End Time Point (Zero Crossing Point) of Half Period
Vac AC Voltage
ZC1 First Detection Signal
ZC2 Second Detection Signal

The invention claimed is:

1. A lighting control device, comprising:

a pair of input terminals electrically connected to an illumination load and an AC power supply;

a bidirectional switch configured to switch between conduction and non-conduction of a bidirectional current between the pair of input terminals;

an inputter configured to receive a dimming level specifying a magnitude of a light output of the illumination load;

a controller configured to control the bidirectional switch so as to retain the bidirectional switch in an ON state for an on time having a length determined in accordance with the dimming level within a prescribed range in each of half periods of an AC voltage of the AC power supply; and a corrector configured to determine, with reference to a determination condition, whether or not a target waveform which is a waveform of at least one of a voltage and a current input to the pair of input terminals has an anomaly and to correct the prescribed range so as to narrow the prescribed range when the target waveform has the anomaly.

2. The lighting control device according to claim 1, further comprising:

a storage configured to store the prescribed range, wherein the storage stores the prescribed range corrected by the corrector.

3. The lighting control device according to claim 2, wherein the prescribed range is defined by an upper limit value and a lower limit value, and the corrector is configured to change at least one of the upper limit value and the lower limit value to correct the prescribed range.

4. The lighting control device according to claim 3, further comprising:

a phase detector configured to output a detection signal to the corrector when the phase detector detects a zero crossing point of the AC voltage, wherein the target waveform is a voltage waveform, and the determination condition is that the detection signal is regularly input from the phase detector to the corrector, and the corrector is configured to determine that the target waveform has the anomaly when the detection signal is irregularly input to the corrector.

5. The lighting control device according to claim 3, further comprising:

a phase detector configured to output a detection signal to the corrector and the controller when the phase detector detects a zero crossing point of the AC voltage, wherein the controller is configured to estimate a zero crossing point of the AC voltage of at least the half period ahead in future based on the detection signal for one time to obtain a virtual zero crossing point and to generate a virtual signal at the virtual zero crossing point, and the determination condition is that at least one of the detection signal and the virtual signal is regularly input to the corrector, and the corrector is configured to determine that the target waveform has the anomaly when either one of the detection signal and the virtual signal is irregularly input to the corrector.

6. The lighting control device according to claim 2, further comprising:

a phase detector configured to output a detection signal to the corrector when the phase detector detects a zero crossing point of the AC voltage, wherein the target waveform is a voltage waveform, and the determination condition is that the detection signal is regularly input from the phase detector to the corrector, and the corrector is configured to determine that the target waveform has the anomaly when the detection signal is irregularly input to the corrector.

7. The lighting control device according to claim 2, further comprising:

a phase detector configured to output a detection signal to the corrector and the controller when the phase detector detects a zero crossing point of the AC voltage, wherein the controller is configured to estimate a zero crossing point of the AC voltage of at least the half period ahead in future based on the detection signal for one time to obtain a virtual zero crossing point and to generate a virtual signal at the virtual zero crossing point, and the determination condition is that at least one of the detection signal and the virtual signal is regularly input to the corrector, and the corrector is configured to determine that the target waveform has the anomaly when either one of the detection signal and the virtual signal is irregularly input to the corrector.

8. The lighting control device according to claim 1, wherein the prescribed range is defined by an upper limit value and a lower limit value, and the corrector is configured to change at least one of the upper limit value and the lower limit value to correct the prescribed range.

9. The lighting control device according to claim 8, further comprising:

a phase detector configured to output a detection signal to the corrector when the phase detector detects a zero crossing point of the AC voltage, wherein the target waveform is a voltage waveform, and the determination condition is that the detection signal is regularly input from the phase detector to the corrector, and the corrector is configured to determine that the target waveform has the anomaly when the detection signal is irregularly input to the corrector.

10. The lighting control device according to claim 8, further comprising:

a phase detector configured to output a detection signal to the corrector and the controller when the phase detector detects a zero crossing point of the AC voltage, wherein the controller is configured to estimate a zero crossing point of the AC voltage of at least the half period ahead in future based on the detection signal for one time to obtain a virtual zero crossing point and to generate a virtual signal at the virtual zero crossing point, and the determination condition is that at least one of the detection signal and the virtual signal is regularly input to the corrector, and the corrector is configured to determine that the target waveform has the anomaly when either one of the detection signal and the virtual signal is irregularly input to the corrector.

11. The lighting control device according to claim 1, further comprising:

a phase detector configured to output a detection signal to the corrector when the phase detector detects a zero crossing point of the AC voltage, wherein the target waveform is a voltage waveform, and the determination condition is that the detection signal is regularly input from the phase detector to the corrector, and the corrector is configured to determine that the target waveform has the anomaly when the detection signal is irregularly input to the corrector.

12. The lighting control device according to claim 1, further comprising:

a phase detector configured to output a detection signal to the corrector and the controller when the phase detector detects a zero crossing point of the AC voltage, wherein the controller is configured to estimate a zero crossing point of the AC voltage of at least the half period ahead in future based on the detection signal for one time to obtain a virtual zero crossing point and to generate a virtual signal at the virtual zero crossing point, and the determination condition is that at least one of the detection signal and the virtual signal is regularly input to the corrector, and the corrector is configured to determine that the target waveform has the anomaly when either one of the detection signal and the virtual signal is irregularly input to the corrector.

* * * * *